United States Patent [19]

Wada

[11] 4,259,999

[45] Apr. 7, 1981

[54] GAS PRECHARGED, LIQUID FILLING MACHINE OPERATING WITH DUAL ROWS OF CONTAINERS

[75] Inventor: Yoshinobu Wada, Matsutoh, Japan

[73] Assignee: Shibuya Kogyo Company, Ltd., Kanazawa, Japan

[21] Appl. No.: 51,028

[22] Filed: Jun. 22, 1979

[30] Foreign Application Priority Data

Dec. 15, 1978 [JP] Japan ..... 53-174553[U]
Dec. 20, 1978 [JP] Japan ..... 53-176116[U]

[51] Int. Cl.[3] ..... B67C 3/28

[52] U.S. Cl. ..... 141/57; 141/140; 141/172; 141/186; 141/237

[58] Field of Search ..... 141/129, 186, 237, 238–246, 141/99, 172, 57, 37–56, 58–68, 140–162

[56] References Cited

U.S. PATENT DOCUMENTS 2,367,899 1/1945 Stewart ..... 141/57
2,775,269 12/1956 Breeback ..... 141/172

*Primary Examiner*—Houston S. Bell, Jr.

*Attorney, Agent, or Firm*—Blanchard, Flynn, Thiel, Boutell & Tanis

[57] ABSTRACT

A gas precharged, liquid filling machine operating with dual rows of containers includes a pair of concentrically disposed inner and outer rows of container receptacles, and an array of pairs of inner and outer gas precharged, filling mechanisms which are disposed directly above the respective rows of container receptacles. The pair of inner and outer filling mechanisms each include a valve which is independently operated, in accordance with the presence or absence of a container, by means of coaxially disposed rotary shafts. Snifter mechanisms for both filling mechanisms are simultaneously operated by a common snifter shaft. Each pair of inner and outer container receptacles, which are modularized, are mounted on a common elevating member in a manner to permit their elastic downward displacement in response to undue stresses applied thereto, thus avoiding the risk that the containers or bottles may be broken. This, in conjunction with the "no bottle-no filling" feature, completely prevents the liquid and pressurizing gas from splashing to the surrounding environment.

10 Claims, 9 Drawing Figures

GAS PRECHARGED, LIQUID FILLING MACHINE OPERATING WITH DUAL ROWS OF CONTAINERS

BACKGROUND OF THE INVENTION

1. Field of the Invention

The invention relates to a gas precharged, liquid filling machine operating with dual rows of containers, typically used to fill a medical liquid into containers, and more particularly, to such machine operating with a pair of concentrically disposed inner and outer rows of container receptacles and corresponding gas precharged, liquid filling mechanisms which fill a liquid into containers placed on the receptacles, together with a pressurized gas.

2. Description of the Prior Art

In a conventional gas precharged, liquid filling machine, the filling liquid is transferred under pressure into a container previously filled with a pressurized gas, for example, a pressurized inert gas, while sealing the opening of the container with a packing associated with a filling nozzle. Subsequently, a snifting opening having a reduced flow area is opened to permit a gradual release of the pressurized gas within the container to the outside before the opening of the container is moved away from the packing so that the internal pressure of the container approaches atmospheric pressure before the opening moves away from the packing. In a machine of the kind described which operates with dual rows of containers, means is provided which controls the opening and closing of each valve of the inner and outer filling nozzles independently in order to accomplish the "no bottle-no filling" feature in the event only one container is supplied below a pair of inner and outer filling nozzles for some reason. However, separate control means is associated with each valve to provide an independent control Specifically, an outer valve is disposed at a low elevation with its valve opening and closing mechanism while an inner valve is disposed at a higher elevation with a separate valve opening and closing mechanism. This results in a complex arrangement of the entire valve operating mechanism. A separate snifter mechanism is associated with each of the inner and outer filling mechanisms, causing further complexity and, contributing to the size and the cost of the overall apparatus.

It will be appreciated that a gas precharged, liquid filling machine fills the liquid into the container, which is precharged with a pressurized gas, and hence it is subject to a greater degree of risk in the event of breakage of bottles than a filling machine which utilizes no pressurized gas precharge. Thus, it is highly desirable to provide some means which assures a complete elimination of the likelihood of breakage of bottles. However, the conventional arrangement provides a mechanically fixed spacing between the filling nozzles and the pair of container receptacles on which containers are placed for upward and downward movement, giving rise to the likelihood of breakage of bottles. Specifically, although a pair of inner and outer container receptacles are designed to move up and down simultaneously during their normal operation to thereby permit a common use of a single elevator for the pair of receptacles, in practice, the fixed distance between the pair of receptacles and their associated filling nozzles may cause undue stresses to be applied to and to cause damage of one of the two containers disposed between the pair of receptacles and the corresponding nozzles, due to differences in the size of similar containers or to an inadvertent mixture of containers of different sizes. The resulting breakage of containers and associated splashing of the filling liquid to be filled and the pressurized gas to the surrounding environment destroys the "no bottle-no filling" feature. As a consequence, preventing container breakage is as significant as the achievement of the "no bottle-no filling" feature.

SUMMARY OF THE INVENTION

It is an object of the invention to provide a gas precharged, liquid filling machine operating with dual container rows which includes a pair of inner and outer filler mechanisms which are highly modularized and simplified in construction, reducing the number of parts used.

It is another object of the invention to achieve the "no bottle-no filling" feature which prevents valves from opening whenever containers are absent from the container receptacles, by providing a simplified valve operating mechanism associated with a pair of inner and outer filler mechanisms.

It is a further object of the invention to provide a gas precharged, liquid filling machine operating with dual container rows which is not susceptible to breakage of containers to thereby assure the "no bottle-no filling" feature and which prevents the occurrence of splashing of the filling liquid to associated pressurized gas to the surrounding environment under any circumstance.

It is an additional object of the invention to provide a snifter mechanism for releasing the pressurized gas from the filled container which is simplified in construction by associating it with a pair of inner and outer filler mechanisms.

The above and other objects, features and advantages of the invention will become apparent from the following description of an embodiment thereof when taken together with the drawings.

DESCRIPTION OF PREFERRED EMBODIMENTS

Figure 1:
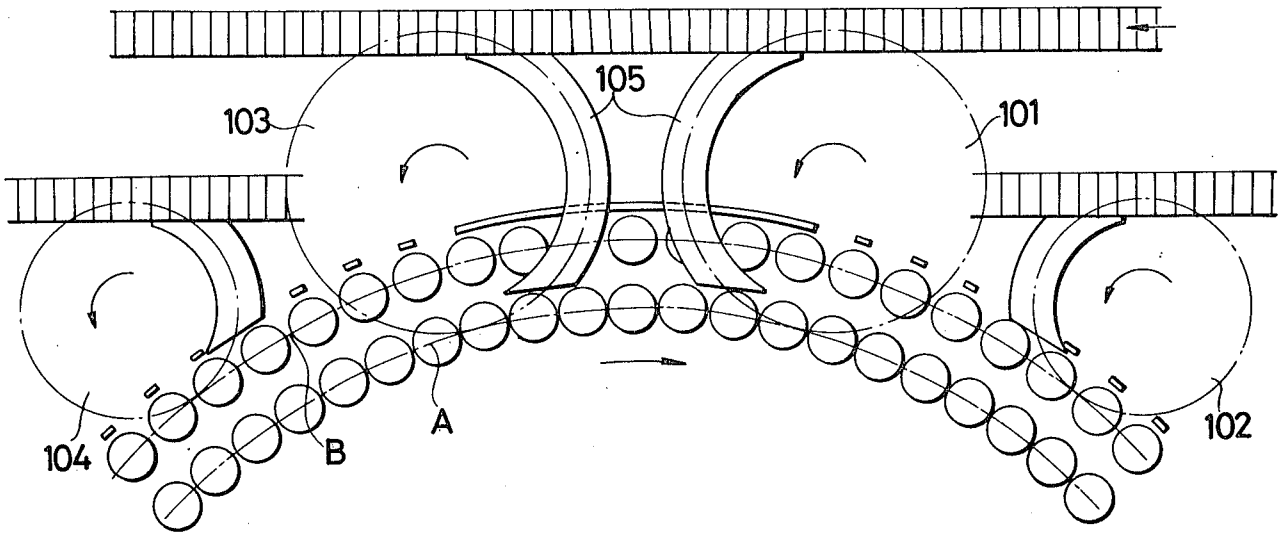
FIG. 1 is a partial plan view of a gas precharged, liquid filling machine embodying the present invention, particularly illustrating the supply and discharge stations thereof where the containers are supplied to or discharged from container receptacles thereof.

Referring to FIG. 1, there is shown a gas precharged, liquid filling machine operating with dual rows of containers A and B. Empty containers are supplied to the respective rows through supply star wheels 101, 102, and the rows of receptacles are raised upwardly toward filling nozzles as the containers are conveyed in order to fill a pressurized gas and a liquid into the containers, whereupon the now filled containers are discharged through discharge star wheels 103, 104. To assure smooth delivery of containers with the inner row of container receptacles A, delivery plates 105 are disposed in the region of star wheels 101, 103 so as to avoid an interference with the outer row of container receptacles.

Figure 2:
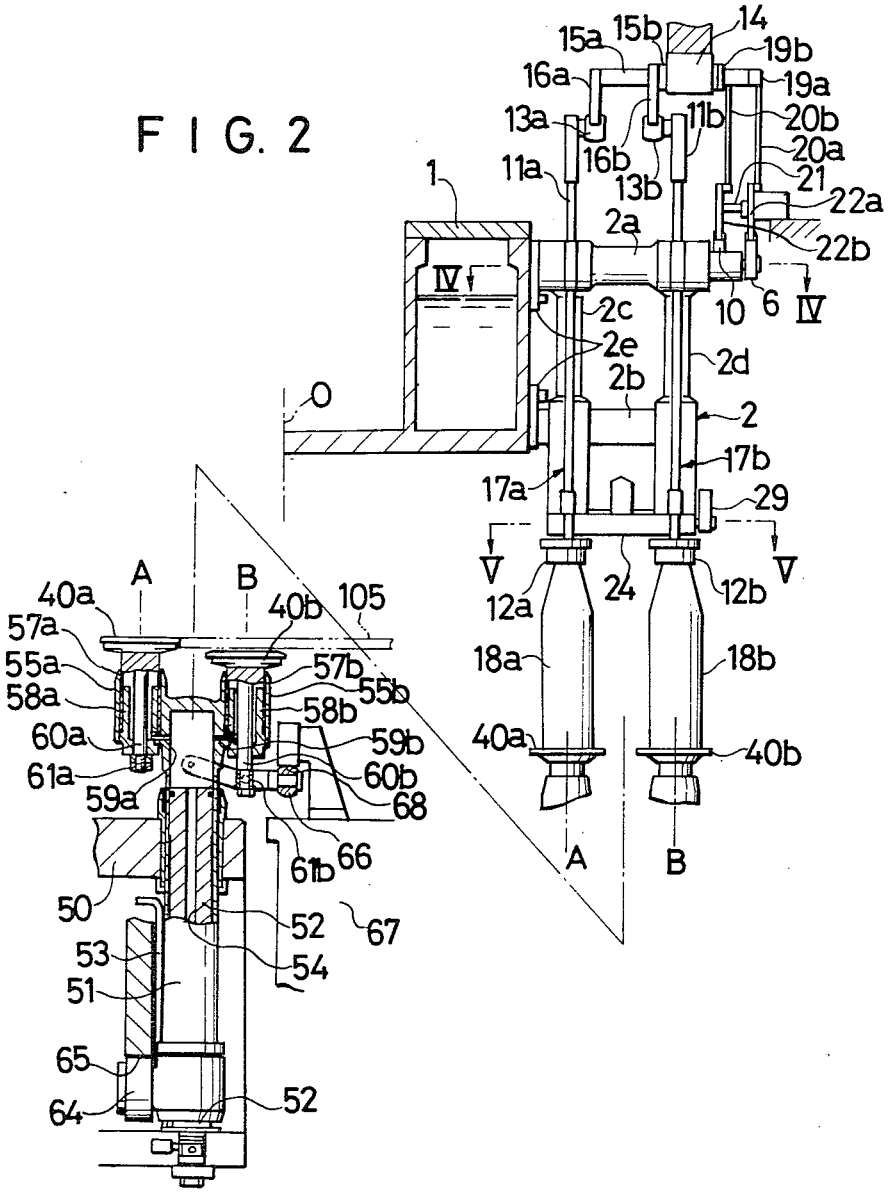
FIG. 2 is a front view, partly in section, of a pair of inner and outer rows of container receptacles and filler mechanisms which are located directly above them.
Figure 4:
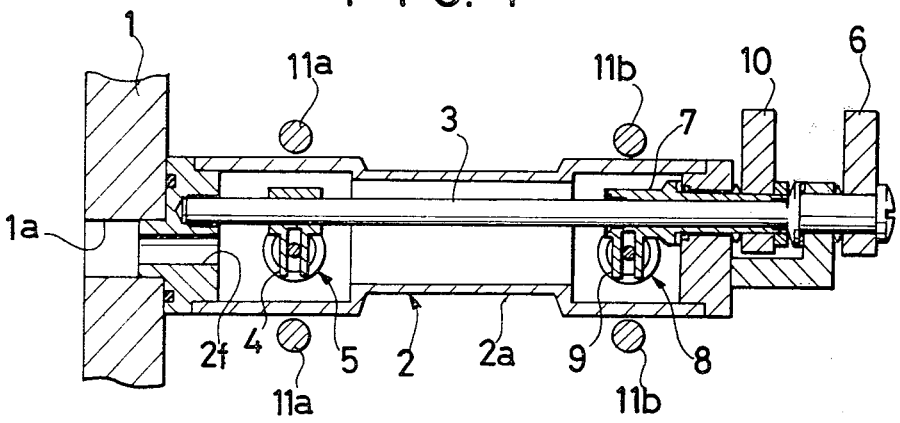
FIG. 4 is a cross section taken along the line IV—IV shown in FIG. 2.

Referring to FIG. 2, there is shown a liquid reservoir 1 which is adapted to be driven for rotation about a common axis 0 together with the rows A, B of container receptacles. A number of casings 2 are mounted on the outer peripheral wall of the reservoir 1 and are spaced apart a given angular increment circumferentially. Each casing 2 includes a pair of vertically spaced, radially extending hollow cylindrical portions 2*a*, 2*b*, and a pair of upright hollow cylindrical portions 2*c*, 2*d* which integrally join the radially inner and outer ends of cylindrical portions 2*a*, 2*b*. The radially inner end of radial portions 2*a*, 2*b* is provided with a mount 2*e* which is used to mount the respective portions 2*a*, 2*b* on the peripheral wall of the reservoir 1. As shown in FIG. 4, the upper radial portion 2*a* has an opening 2*f* which is in communication with the top region of the reservoir 1 through an opening 1*a* formed in the wall of the reservoir 1 while the lower radial portion 2*b* communicates with the bottom region of the reservoir 1 in a similar manner. Consequently, a liquid which is contained within the reservoir 1 is introduced through the lower radial portion 2*b* into the upright portions 2*c* and 2*d* to the same level as that within the reservoir 1. On the other hand, a pressurized gas which is introduced into the top space within the reservoir 1 in order to pressurize the liquid is introduced into the top of the upright portions 2*c*, 2*d* through the upper radial portion 2*a*. A gas precharged, liquid filling nozzle, not shown, which may be of any known construction, is disposed in each of the upright portions 2*c*, 2*d*.

Each of the filling nozzles includes a valve operating mechanism. Specifically, referring to FIG. 4, a rotary shaft 3 is rotatably mounted in the radial portion 2*a* of each casing 2, with its outer end projecting out of the radial portion 2*a*. A forked arm 4 is secured to the radially inner end of the rotary shaft 3, and is engaged with a valve 5 associated with a radially inner filling nozzle while a cam 6 is fixedly mounted on the radially outer end of the rotary shaft 3 for rotating it. A second rotary shaft 7 is rotatably telescoped over the rotary shaft 3, and has its one end located within the radial portion 2*a* and its other end projecting out of it. The inner end of the rotary shaft 7 is formed with a forked arm 9 which is associated with a valve 8 of an outer filling nozzle. A cam 10 is fixedly mounted on the outer end of the rotary shaft 7. Thus, the cams 6, 10 can be operated to rotate the individual rotary shafts 3, 7 through given angular increments, thereby causing the arms 4, 9 to control independently the opening of the valves 5, 8 associated with the inner and outer filling nozzles.

Figure 3:
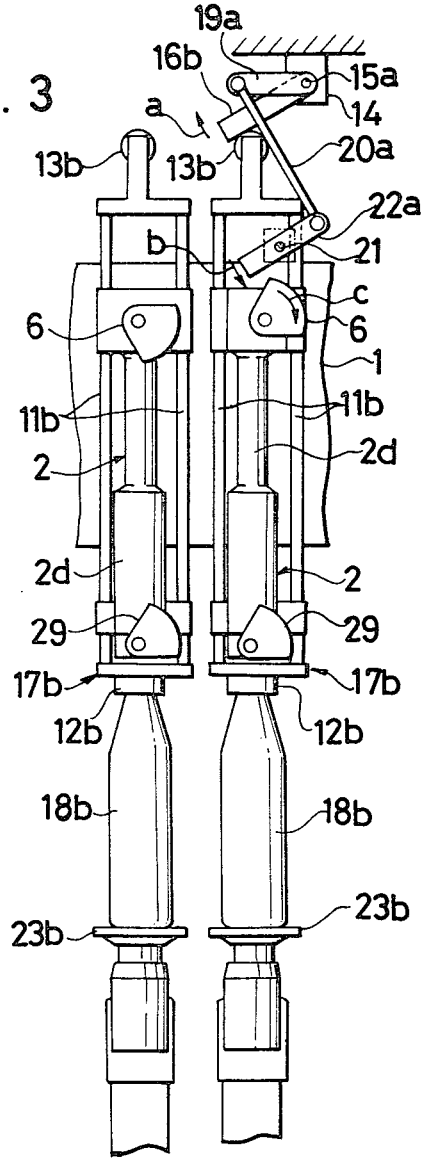
FIG. 3 is a right-hand side elevation of the filler mechanisms shown in FIG. 2.

The operation of the valves 5, 8 is controlled by a detector assembly which detects the presence or absence of a container below the respective filling nozzle. Specifically, each casing 2 is provided with pairs of vertically movable rods 11*a*, 11*b* which are spaced apart on the opposite sides of the individual upright portions 2*c*, 2*d*, as viewed in the direction of rotation thereof. A bottle mouth guide member 12*a* or 12*b* bridges across the lower ends of each pair of rods 11*a*, 11*b* while a roller 13*a* or 13*b* is supported across the upper ends of each pair of rods. A bracket 14 is fixedly mounted on a stationary frame of the filling machine, and rotatably mounts a hollow shaft 15*b* in which a shaft 15*a* is rotatably mounted. Arms 16*a*, 16*b* are fixedly mounted each on one end of individual shafts 15*a*, 15*b*. The guide member 12*a*, 12*b*, rod 11*a*, 11*b* and roller 13*a*, 13*b* constitute together a container guide mechanism 17*a*, 17*b*, and each of the arms 16*a*, 16*b* does not interfere with the associated guide mechanism 17*a*, 17*b* whenever the latter assumes its lower position. However, when the individual guide mechanisms 17*a*, 17*b* are pushed up to their upper positions by associated containers 18*a*, 18*b*, the individual arms 16*a*, 16*b* are angularly driven by the associated rollers 13*a*, 13*b*, respectively, as indicated by an arrow a shown in FIG. 3.

The other end of shafts 15*a*, 15*b* fixedly carries arms 19*a*, 19*b*, the free end of which is connected with one end of connecting rods 20*a*, 20*b*. The other end of the connecting rods 20*a*, 20*b* is connected with one end of inteference arms 22*a*, 22*b* which are pivotally mounted on a shaft 21 which is fixedly mounted on a stationary frame of the machine. The interference arms 22*a*, 22*b* are positioned so as to be capable of interfering with cams 6, 10, respectively, of the valve operating machanism so that when the arms 16*a*, 16*b* are angularly driven in the direction of the arrow a shown in FIG. 3 by the respective rollers 13*a*, 13*b*, such movement is transmitted through the shafts 15*a*, 15*b*, arms 19*a*, 19*b* and connecting rods 20*a*, 20*b* to drive the individual interference arms 22*a*, 22*b* in a direction indicated by an arrow b so as to move then into interference with the cams 6, 10, respectively.

Figure 5:
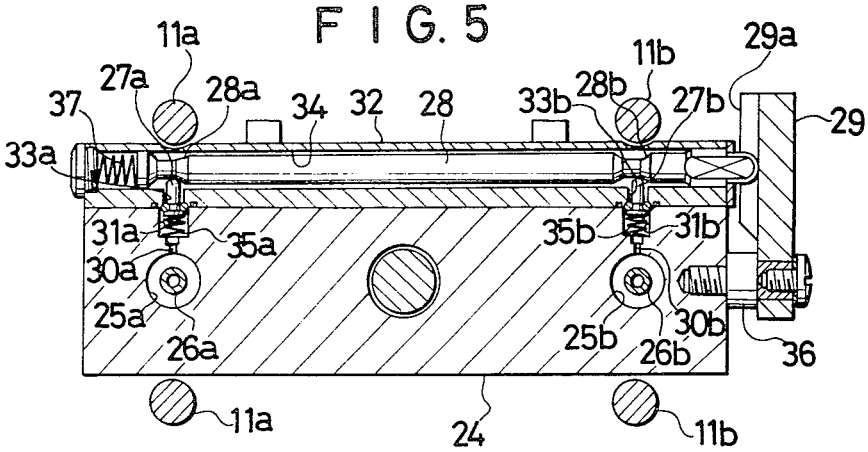
FIG. 5 is a cross section taken along the line V—V shown in FIG. 2.
Figure 6:
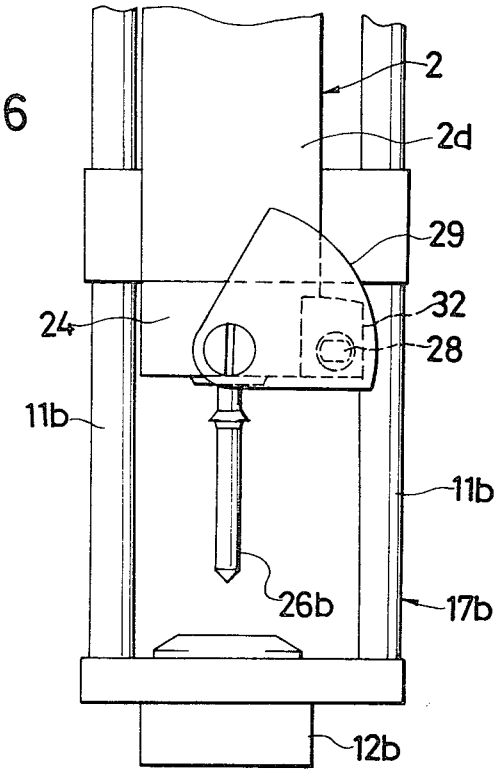
FIG. 6 is a right-hand side elevation of the assembly shown in FIG. 5.

FIGS. 5 and 6 show a snifter mechanism which is associated with the valve operating and controlling mechanism described above. A valve block is shown at 24 and is disposed to bridge across the lower ends of the upright portions 2*c*, 2*d*. A pair of passages 25*a*, 25*b* associated with the inner and outer filling nozzles are formed within the valve block 24, and receive respective filling or gas nozzles 26*a*, 26*b*. As is conventional, a liquid valve 5, 8 (FIG. 4) of the filling nozzle is disposed above the passages 25*a*, 25*b*. The opening of the containers 18*a*, 18*b* is sealed by abutment under pressure against the lower surface of the valve block 24 or against bottle mouth packing disposed on the guide members 12*a*, 12*b* which are located below the valve block 24. Hence, after the liquid is filled into the containers 18*a*, 18*b* and the liquid valve is closed, a pressurized gas is introduced into and confined in the remaining top space within the containers 18*a*, 18*b* and the passages 25*a*, 25*b*.

The purpose of the snifter mechanism is to permit a gradual release of the confined pressurized gas into the atmosphere, and essentially comprises a pair of snifter valves 27*a*, 27*b* which operate to open or close snifter passages, a snifter shaft 28 which concurrently operates the snifter valves, and a cam 29 for operating the snifter shaft 28. The snifter passage comprises a pair of orifice passages 30*a*, 30*b* opening into the respective passages 25*a*, 25*b*, a pair of chambers 31*a*, 31*b* communicating with the respective orifice passages and receiving springs 35*a*, 35*b* therein, a pair of radially extending openings 33*a*, 33*b* formed in a cylindrical member 32 which is secured to the valve block 24, and an axial bore 34 of the cylindrical member 32. The snifter valves 27*a*, 27*b* are loosely fitted in the openings 33*a*, 33*b*, and are urged by the springs 35*a*, 35*b* to have their one end projecting into the bore 34. Under this condition, the inner end of the snifter valves 27*a*, 27*b* bear against the corresponding valve seats formed in the openings 33*a*, 33*b*, thus closing the snifter passages.

The cam 29 is sector-shaped in configuration, with its apex pivotally mounted on the valve block 24 by means of a pin 36, the rear surface of the cam providing a cam surface 29*a*. The snifter shaft 28 is slidably disposed within the bore 34 and is urged by a spring 37 to have its free end maintained in resilient abutment against the cam surface 29*a*. At given positions along its length, the snifter shaft 28 is formed with a pair of cams 28*a*, 28*b* which are engaged by the snifter valves 27*a*, 27*b*, respectively.

Returning to FIGS. 1 and 2, the construction of container receptacles 40*a*, 40*b* and a mechanism which is used to move these receptacles up and down will now be described. In FIG. 2, there is shown a turntable 50 which is adapted to rotate about the axis 0 together with the liquid reservoir 1. A cylinder 51 extends vertically through the turntable and is supported thereby so as to be vertically movable. A guide rod 52 is fitted inside the cylinder 51, and is secured to a part of the turntable 50. The rod is axially formed with air passage 54 which is supplied with compressed air from an air hose 53.

The top end of the cylinder 51 is provided with a pair of guide sleeves 55*a*, 55*b* each receiving a slidable sleeve 57*a*, 57*b*, the upper end face of which is formed as the container receptacle 40*a*, 40*b*. A guide sleeve 58*a*, 58*b* having a closed bottom is fitted inside each slidable sleeve 57*a*, 57*b* and is fixedly connected with the cylinder 51. The sleeve 58*a*, 58*b* communicates with the cylinder 51 through passages 59*a*, 59*b*. In this manner, the slidable sleeves 57*a*, 57*b* are urged to move upward in response to compressed air which is applied to the cylinder 51, but its upper limit is defined by the abutment of stops 61*a*, 61*b*, located at the lower end of the rods 60*a*, 60*b* secured to the slidable sleeves 57*a*, 57*b*, against the guide sleeves 58*a*, 58*b*, respectively.

The lower end of the cylinder 51 fixedly carries a roller 64, which engages a cam surface 65 formed on the peripheral surface of the lower end of a cylindrical guide. Because the cylinder 51 is urged to move upward by the pressure of the compressed air supplied thereto, it moves vertically up and down in accordance with the configuration of the cam surface 65 during its rotation.

The container receptacle 40*b* which forms the radially outer row B is provided with a roller 66 which is mounted on a horizontal shaft extending from the lower end of its rod 60*b* and engaging with a cam 68 which is disposed on a stationary frame 67. The cam 68 is located at a position corresponding to the delivery plate 105 so that when the container receptacle 40*b* has reached the position of the delivery plate 105, it engages the roller 66 to cause a forced downward movement of the rod 60*b*, slidable sleeve 57*b* and container receptacle 40*b*, thus preventing the interference between the container receptacle 40*b* and the delivery plate 105.

In operation, the containers which are placed on the individual container receptacles 40*a*, 40*b* move along a circular path as the liquid reservoir 1 and the turntable 50 rotate, and also moves up and down as the cylinder 51 moves vertically during such rotation. Specifically, in response to the compressed air supplied thereto, the cylinder 51 is urged to move upward, and its upper position is controlled by the cam surface 65. The cam surface 65 defines an upper position of a higher elevation at the filling station, whereby the receptacles 40*a*, 40*b* and the containers 18*a*, 18*b* move upward toward the filling nozzles, not shown. Consequently, the container guide mechanisms 17*a*, 17*b* are pushed up by the respective containers 18*a*, 18*b*, whereby the rollers 13*a*, 13*b* of the mechanisms 17*a*, 17*b* are driven into position where they are capable of interference with the arms 16*a*, 16*b*. During the rotation of the turntable, the rollers 13*a*, 13*b* interfere with the arms 16*a*, 16*b* to cause them to rotate in the direction of the arrow a shown in FIG. 3, whereupon the interference arms 22*a*, 22*b* angularly move in the direction of the arrow b shown in FIG. 3 to interfere with the corresponding cams 6, 10. This results in an angular movement of the cams 6, 10 in the direction of the arrow c shown in FIG. 3, permitting the rotation of the cams 6, 10 to be transmitted through the rotary shaft 3, 7 to the forked arms 4, 9, thus opening the respective valves of the inner and outer filling nozzles. A filling operation of the liquid takes place in a known manner, but it should be understood that each container is initially precharged with a pressurized inert gas before the container is filled with the liquid. When the filling operation is completed, the cams 6, 10 bear against fixed cams, not shown, which cause them to rotate in the opposite direction from that indicated by the arrow c, thus closing the individual valves.

If a container is not supplied to one of the pair of container receptacles 40*a*, 40*b* for some reason, for example, if no container 18 is supplied to the receptacle 40*a*, the filling operation takes place in a normal manner as mentioned above with respect to the other container 18*b*, but the upward movement of the receptacle 40*a* cannot cause a corresponding movement of the guide mechanism 17*a*, which is therefore incapable of producing an interference between the roller 13*a* and the arm 16*a*. As a consequence, the interference arm 22*a* remains in its position where it is incapable of interfering with the cam 6, which moves past the interference cam 22*a* without opening the valve, thus preventing a filling operation. In other words, the "no bottle-no filling" feature is achieved.

When containers having different heights are held between the pair of container receptacles 40*a*, 40*b* and the corresponding guide mechanisms 17*a*, 17*b* to cause undue stresses applied to one of the receptacles, these stresses are accommodated by a resilient displacement of the associated receptacle downward inasmuch as the receptacles are resiliently supported by the cylinder 51 under the pressure of the compressed air. In this manner, an accident such as a breakage of container is avoided while enabling the filling operation.

Upon completion of the filling operation, a further rotation of the reservoir 1 causes the cam 29 of the snifter mechanism to be moved angularly as a result of its contact with a fixed cam, not shown. Then the snifter shaft 28 is urged to the left, as viewed in FIG. 5, by the cam surface 29*a* against the resilience of the spring 37, whereby the snifter valves 27*a*, 27*b* engaging the cams 28*a*, 28*b* on the snifter shaft 28 are displaced against the resilience of the springs 35*a*, 35*b*, thus opening the snifter passage. As a result, the high pressure gas which remains confined in the remaining top space of the containers 18*a*, 18*b* and the passages 25*a*, 25*b* is gradually discharged, with its flow rate being limited by the orifice passages 30*a*, 30*b* until the internal pressure of the containers 18*a*, 18*b* decreases gradually to atmospheric pressure.

When the internal pressure of the containers 18*a*, 18*b* approaches or reaches the atmospheric pressure, they are carried down by the receptacles 40*a*, 40*b* and discharged out of the filling machine. In the meantime, the cam 29 is returned to its original position by the fixed cam, not shown, whereby the snifter shaft 28 as well as the snifter valves 27*a*, 27*b* resume their original position, thus closing the snift passage.

Figure 7:
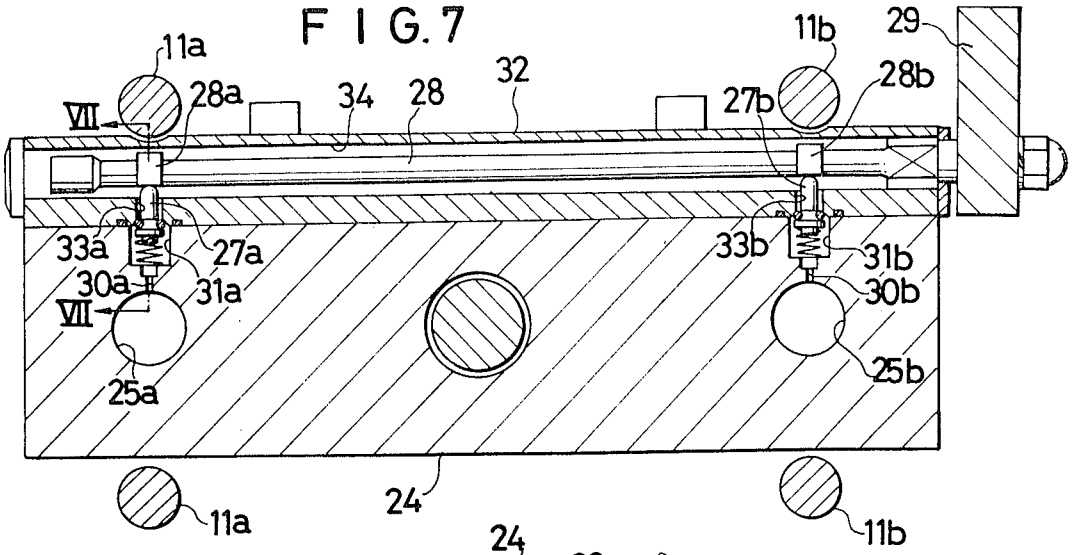
FIG. 7 is a cross section similar to FIG. 5, illustrating another embodiment of the snifter mechanism of the invention.
Figure 8:
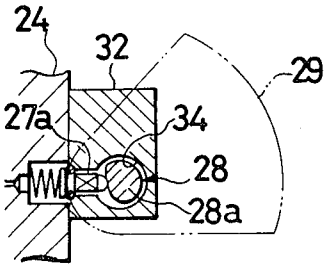
FIG. 8 is a cross section taken along the line VIII—VIII shown in FIG. 7.

In the embodiment described above, a rotation of the cam 29 caused an axial movement of the snifter shaft 28. However, an axial movement of the snifter shaft 28 can be directly achieved without the cam 29, by providing a fixed can which operates over a given angular interval. Alternatively, FIGS. 7 and 8 show the snifter shaft 28 rotatably journalled in the cylindrical member 32 and fixedly carrying the cam 29 with a pair of circumferential cam surfaces 28*a*, 28*b* formed on the snifter shaft 28. In this arrangement, a rotation of the snifter shaft 28 controls the opening and closing of the snifter valves 27*a*, 27*b*.

Figure 9:
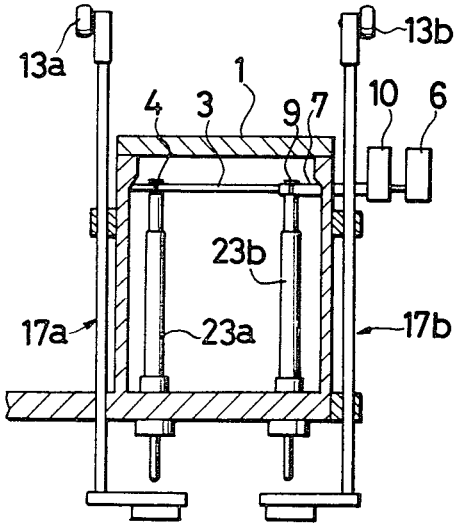
FIG. 9 is a front view, partly in section, of another embodiment of a filling valve assembly.

FIG. 9 shows a modification of a valve operating mechanism which permits an independent control of respective filling nozzles 23*a*, 23*b* which are disposed within the reservoir 1 in accordance with the presence or absence of containers.

In the embodiment described above, a mechanical arrangement is used to control the position of the interference arms 22*a*, 22*b* in accordance with the presence or absence of the containers 18*a*, 18*b*. However, a similar control can be achieved by connecting the interference arms 22*a*, 22*b* or similar interference member with corresponding solenoids, which are electrically energized or deenergized by limit switches operated by the rollers 13*a*, 13*b* or phototubes which detects the presence or absence of the containers 18*a*, 18*b* directly.

To achieve a resilient support for the container receptacles 40*a*, 40*b*, springs may be used instead of or in conjunction with the compressed air. However, the described arrangement is advantageous in providing a simplified construction. Similarly, the cylinder 51, which represents an elevator member, may be urged upward by a spring. Alternatively, a groove cam may be used to accomplish a positive vertical movement of the elevating member.

In the embodiment described, a guide mechanism is provided to cause a downward movement of the outer row of the container receptacles 40*b* in the region of delivery plates 105, which is provided to assure a smooth delivery of containers to or from the inner row. However, the provision of such mechanism is not essential. By way of example, the outer container receptacles 40*b* may be disposed at a lower elevation than the inner one 40*a*. Furthermore, the delivery plates 105 can be dispensed with by providing a pair of rectangular receptacles which adjoin with each other so that the container can be supplied onto the inner receptacle after sliding over the outer receptacle.

While the invention has been described with reference to particular embodiments thereof, it should be understood that other changes and modifications will readily occur to those skilled in the art and hence the invention is not limited to the specific embodiments described herein, but is solely defined by the appended claims.

What is claimed is:

1. A machine for filling containers with a pressurized liquid, comprising:

a reservoir for containing a liquid and a gas under pressure;

a filling table supported for rotation about a vertical axis;

a plurality of pairs of radially aligned container support members mounted on said table and forming two circular rows concentric with said axis;

a filler mechanism spaced vertically above each of said pairs of container support members and supported for rotation therewith about said axis, each of said filler mechanisms having a pair of valved filler heads respectively disposed above the pair of container support members for sealing engagement with the tops of containers on said container support members, said filler mechanisms communicating with said reservoir whereby containers can be filled with the liquid when the valves of said filler heads are open;

means on said table for vertically raising said container support members to move the containers on said container support members into said sealing engagement with said filler heads;

snifter means associated with said filler heads for discharging pressurized gas from a filled container to the atmosphere;

container detector means for detecting the presence or absence of containers on said container support members;

filler valve operating means for each pair of valved filler heads, said filler valve operating means comprising first and second, coaxial, independently rotatable shafts, first connecting means operatively connecting said first shaft to the valve of one of said pair of valved filler heads and second connecting means operatively connecting said second shaft to the valve of the other of said pair of valved filler heads so that said valves can be independently opened and closed by independent rotation of said first and second shafts; and means operable in response to said container detector means to independently rotate said first and second shafts to open said valves only when containers are present on the container support members associated with the valves.

2. The machine as claimed in claim 1, in which said container detector means comprises a separate detector for each filler head, each of said detectors being mounted for vertical movement between a lower first position and a higher second position, each detector including rod means, a rotatable roller mounted on the upper end of said rod means and a container guide mounted on said rod means beneath the filler head so that a container being raised by the associated container support member will engage said container guide and lift said detector from said first position to said second position;

said first shaft is a hollow outer shaft extending radially of the table axis, said second shaft is an inner shaft coaxially disposed within said outer shaft for rotation relative thereto and extending beyond each end of said outer shaft, the end of each of said shafts remote from said table axis having a radially extending cam thereon and the other end of each of said shafts being disposed adjacent the valve for a respective one of said filler heads and having an arm for operating the valve when the shaft is rotated through a predetermined angle; and a pair of interference means disposed above and fixed with respect to the path of rotation of said filler mechanisms about said table axis, each interference means having a pivotally mounted interference arm and means for pivoting said interference arm by contact with the roller on a respective one of said detectors when the detector is in said second position to effect pivoting of said interference arm into the path of travel about said table axis of a corresponding one of said cams, whereby the cam is displaced in a manner effecting rotation of its associated shaft through said predetermined angle, thereby opening the associated filler head valve.

3. The machine according to claim 2, wherein said reservoir comprises an annular chamber coaxial with said table axis, and said filler mechanisms are mounted on the outer peripheral surface thereof at circumferentially spaced intervals.

4. The machine according to claim 2, wherein said reservoir comprises an annular chamber coaxial with said table axis, said filler mechanisms being disposed substantially within said reservoir.

5. The machine according to claim 2, wherein said receptacle support means comprise a common elevating member for each said pair of container receptacles, which said elevating member is activated by compressed air.

6. A machine for filling containers with a pressurized liquid, comprising:

a reservoir for containing a liquid and a gas under pressure;

a filling table supported for rotation about a vertical axis;

a plurality of pairs of radially aligned container support members mounted on said table and forming two circular rows concentric with said axis;

a filler mechanism spaced vertically above each of said pairs of container support members and supported for rotation therewith about said axis, each of said filler mechanisms having a pair of valved filler heads respectively disposed above the pair of container support members for sealing engagement with the tops of containers on said container support members, said filler mechanisms communicating with said reservoir whereby containers can be filled with the liquid when the valves of said filler heads are open;

means on said table for vertically raising said container support members to move the containers on said container support members into said sealing engagement with said filler heads;

container detector means for detecting the presence or absence of containers on said container support members;

filler valve operating means for each pair of valve filler heads including means for independently opening and closing the valves of said filler heads in response to said container detector means so that said valves are opened only when containers are present on the container support members associated with the valves;

a snifter mechanism for each pair of valved filler heads for discharging pressurized gas from a filled container to the atmosphere, said snifter mechanism including means defining a pair of passages for communicating with the upper ends of containers which are in sealing engagement with the filler heads, a pair of snifter valves each associated with one of said passages for controlling the discharge of said pressurized gas from one of the containers, a movable snifter shaft, a pair of cams on said snifter shaft and which engage said snifter valves to open or close same simultaneously in response to movement of said snifter shaft.

7. The machine as claimed in claim 6 in which said means defining said pair of passages comprises a valve block, a tubular shaft housing extending radially of the table axis and secured to said valve block, the central opening in said shaft housing communicating with a point of atmospheric pressure external to said housing and said valve block;

said snifter shaft being supported in the central opening in said shaft housing for movement relative thereto;

said snifter passages including a spaced pair of vertical first passageways in said valve block, each spaced from said shaft housing and in communication with the inside of a container sealingly engaged with a respective filling head, and a pair of parallel horizontal second passageways, each extending from a respective one of said first passageways through said valve block and the wall of said shaft housing to said central opening in said shaft housing;

an annular valve seat in the walls of each of said second passageways, said valve seat facing away from said snifter shaft, a valve member in each of said second passageways, and a coil spring supported in each of said second passageways to continuously urge said valve member against said valve seat, in which position movement of gas in said second passageway is blocked, said valve member having a tip of the valve member protruding into said central opening; and said cams on said snifter shaft being respectively disposed adjacent said tips of said valve members and cooperable therewith in response to said movement of said shaft in said opening to simultaneously move each said valve member away from its associated valve seat against the urging of said coil spring, whereby pressurized gas in the tops of the containers sealingly engaging the filler heads will be vented to the atmosphere through the respective first and second passageways and the central opening.

8. The machine according to claim 7, wherein said snifter shaft is axially slidable relative to said shaft housing, a helical shaft spring supported in said central opening and urging said shaft away from said table axis in a direction axially of said shaft housing, said cams being defined by the walls of two annular circumferential grooves in said snifter shaft, said walls being inclined relative to the axis of said snifter shaft, said tips of said valve members extending into said grooves, and the end of said snifter shaft remote from said table axis extending outside said shaft housing, whereby engagement of said end of said snifter shaft with trip means effects an axial movement of said snifter shaft toward said table axis against the force of said shaft spring and causes said cams to effect said movement of said valve members away from said valve seats.

9. The machine according to claim 7, wherein said snifter shaft is rotatably journaled in said shaft housing, and the end of said snifter shaft remote from said table axis extending outside said shaft housing and having a radially extending cam lever, whereby engagement of said cam lever with trip means on said machine rotates said snifter shaft and causes said cams to effect said movement of said valve members away from said valve seats.

10. A machine for filling containers with a pressurized liquid, comprising:

a reservoir for containing a liquid and a gas under pressure;

a filling table supported for rotation about a vertical axis;

a plurality of pairs of radially aligned container support members mounted on said table and forming two circular rows concentric with said axis;

a filler mechanism spaced vertically above each of said pairs of container support members and supported for rotation therewith about said axis, each of said filler mechanisms having a pair of valved filler heads respectively disposed above the pair of container support members for sealing engagement with the tops of containers on said container support members, said filler mechanisms communicating with said reservoir whereby containers can be filled with the liquid when the valves of said filler heads are open;

means on said table for vertically raising said container support members to move the containers on said container support members into said sealing engagement with said filler heads;

container detector means for detecting the presence or absence of containers on said container support members;

filler valve operating means for each pair of valved filler heads, said filler valve operating means comprising first and second, coaxial, independently rotatable shafts, first connecting means operatively connecting said first shaft to the valve of one of said pair of valved filler heads and second connecting means operatively connecting said second shaft to the valve of the other of said pair of valved filler heads so that said valves can be independently opened and closed by independent rotation of said first and second shafts;

means operable in response to said container detector means to independently rotate said first and second shafts to open said valves only when containers are present on the container support members associated with the valves;

a snifter mechanism for each pair of valved filler heads for discharging pressurized gas from a filled container to the atmosphere, said snifter mechanism including means defining a pair of passages for communicating with the upper ends of containers which are in sealing engagement with the filler heads, a pair of snifter valves each associated with one of said passages for controlling the discharge of said pressurized gas from one of the containers, a movable snifter shaft, a pair of cams on said snifter shaft and which engage said snifter valves to open or close same simultaneously in response to movement of said snifter shaft.

* * * * *